US010443179B2

(12) United States Patent
Lee et al.

(10) Patent No.: US 10,443,179 B2
(45) Date of Patent: Oct. 15, 2019

(54) LAUNDRY TREATMENT APPARATUS

(71) Applicant: LG ELECTRONICS INC., Seoul (KR)

(72) Inventors: Jihong Lee, Seoul (KR); Kijung Sung, Seoul (KR); Seungwook Jung, Seoul (KR)

(73) Assignee: LG Electronics Inc., Seoul (KR)

( * ) Notice: Subject to any disclaimer, the term of this patent is extended or adjusted under 35 U.S.C. 154(b) by 83 days.

(21) Appl. No.: 15/197,325

(22) Filed: Jun. 29, 2016

(65) Prior Publication Data

US 2017/0002502 A1 Jan. 5, 2017

(30) Foreign Application Priority Data

Jun. 30, 2015 (KR) ..... 10-2015-0092779
Jun. 14, 2016 (KR) ..... 10-2016-0073973

(51) Int. Cl.

| | |
|---|---|
| ***D06F 39/08*** | (2006.01) |
| ***D06F 39/00*** | (2006.01) |
| ***D06F 29/00*** | (2006.01) |
| ***D06F 37/24*** | (2006.01) |
| ***D06F 39/12*** | (2006.01) |

(52) U.S. Cl.

CPC ..... *D06F 39/085* (2013.01); *D06F 29/00* (2013.01); *D06F 37/24* (2013.01); *D06F 39/00* (2013.01); *D06F 39/08* (2013.01); *D06F 39/12* (2013.01)

(58) Field of Classification Search

CPC ..... D06F 39/08; D06F 39/085; D06F 39/12; D06F 29/00; D06F 29/02; D06F 37/24

See application file for complete search history.

(56) References Cited

U.S. PATENT DOCUMENTS 2,023,013 A * 12/1935 Faber ..... D06F 15/00 427/242
4,870,988 A * 10/1989 Hood, Jr. ..... D06F 39/083 137/343

(Continued)

FOREIGN PATENT DOCUMENTS

CN 2347041 11/1999
CN 1888259 1/2007

(Continued)

OTHER PUBLICATIONS

Taiwan Office Action in Taiwan Application No. 105118999, dated Jul. 31, 2017, 16 pages (with English translation).

(Continued)

*Primary Examiner* — David G Cormier
(74) *Attorney, Agent, or Firm* — Fish & Richardson P.C.

(57) ABSTRACT

A laundry treatment apparatus that includes a cabinet having an opening; a drawer dischargeable from the cabinet through the opening; a receiving unit provided in the drawer for receiving water and laundry; a drain pump for discharging water from the receiving unit; a drain channel extending through a reference point set to be higher than a highest level of water that can be stored in the receiving unit, the drain channel being located outside the cabinet; and a connection channel located in the cabinet for connecting the drain pump and the drain channel to each other, wherein at least a portion of the drain pump is located lower than a bottom surface of the receiving unit is disclosed.

18 Claims, 7 Drawing Sheets

(56) References Cited

U.S. PATENT DOCUMENTS

| | | | | |
|---|---|---|---|---|
| 6,857,295 | B2 * | 2/2005 | Hansen | D06F 37/26 134/104.2 |
| 2007/0101774 | A1 * | 5/2007 | Lee | D06F 39/083 68/208 |
| 2009/0113945 | A1 | 5/2009 | Kim et al. | |
| 2009/0119955 | A1 | 5/2009 | Hong et al. | |
| 2009/0139276 | A1 | 6/2009 | Kim et al. | |
| 2009/0158784 | A1 | 6/2009 | Kim et al. | |
| 2010/0320890 | A1 | 12/2010 | Jung et al. | |
| 2011/0265524 | A1 | 11/2011 | Kim et al. | |
| 2015/0059418 | A1 | 3/2015 | Lee et al. | |
| 2015/0368850 | A1 | 12/2015 | Seo et al. | |
| 2016/0102425 | A1 | 4/2016 | Scheckelhoff | |

FOREIGN PATENT DOCUMENTS

| | | |
|---|---|---|
| CN | 101578410 | 11/2009 |
| CN | 101617077 | 12/2009 |
| CN | 101725015 | 6/2010 |
| CN | 102216515 | 10/2011 |
| CN | 102844486 | 12/2012 |
| CN | 203440679 | 2/2014 |
| CN | 104005205 | 8/2014 |
| CN | 104420122 | 3/2015 |
| EP | 1462561 | 9/2004 |
| EP | 1607511 | 12/2005 |
| EP | 2980301 | 2/2016 |
| FR | 2923844 | 5/2009 |
| JP | H07-318234 | 12/1995 |
| JP | 2015226775 | 12/2015 |
| JP | 2016032636 | 3/2016 |
| KR | 100413459 | 1/2004 |
| KR | 20-0349032 | 4/2004 |
| KR | 10-2015-0025083 | 3/2015 |
| WO | 2008/069607 | 6/2008 |
| WO | 2008/084934 | 7/2008 |
| WO | 2012/150539 | 11/2012 |

OTHER PUBLICATIONS

International Search Report in International Application No. PCT/KR2016/012961, dated Feb. 28, 2017, 17 pages (with English translation).

International Search Report and Written Opinion in International Application No. PCT/KR2016/007038, dated Sep. 12, 2016, 14 pages.

Extended European Search Report issued in European Application No. 16177073.0 dated Sep. 14, 2016, 8 pages.

Chinese Office Action in Chinese Application No. 201610511423.9, dated Jul. 11, 2018, 19 pages.

Chinese Office Action in Chinese Application No. 201610511423.9, dated Jan. 31, 2018, 23 pages.

United States Notice of Action in U.S. Appl. No. 16/193,381, dated Jul. 17, 2019, 9 pages.

* cited by examiner

LAUNDRY TREATMENT APPARATUS

CROSS-REFERENCE TO RELATED APPLICATIONS

This application claims the benefit of Korean Patent Application No. 10-2015-0092779, filed on Jun. 30, 2015, and Korean Patent Application No. 10-2016-0073973, filed on Jun. 14, 2016, both of which are hereby incorporated by reference as if fully set forth herein.

FIELD

The present disclosure relates to a laundry treatment apparatus.

BACKGROUND

A laundry treatment apparatus includes an apparatus that washes laundry such as clothes, an apparatus that dries laundry, and an apparatus that performs both washing and drying of laundry.

The laundry treatment apparatus may include a cabinet, a tub provided in the cabinet for storing water therein, and a drum provided in the tub for storing laundry therein. Conventional laundry treatment apparatuses are classified into front loading type laundry treatment apparatuses configured such that laundry is introduced into a drum through an introduction aperture formed in the front surface of the apparatus and top loading type laundry treatment apparatuses configured such that laundry is introduced into a drum through an introduction aperture formed in the upper surface of the apparatus.

Some conventional laundry treatment apparatuses are configured such that a tub can be discharged from a cabinet. In this case, when the tub is discharged from the cabinet or is inserted into the cabinet, a water supply unit for supplying water to the tub and a discharge unit for discharging water from the tub out of the cabinet may be entangled or twisted.

Conventional laundry treatment apparatuses may include a drain unit for draining water from the tub. The drain unit may include a drain pump and a drain channel for draining water from the tub.

In conventional laundry treatment apparatuses, a predetermined amount of wash water is generally collected in the drain unit in order to prevent the introduction of bad smells from a sewer pipe connected to the drain unit.

In conventional laundry treatment apparatuses, however, it is not possible to completely drain wash water from the drain unit.

Additionally, in conventional laundry treatment apparatuses, wash water collected in the drain unit may be frozen, with the result that the drain unit may be frozen to burst in winter.

Additionally, in the case in which a drain channel of the drain unit is located parallel to the ground, wash water may be collected in the drain channel, with the result that the drain channel may be frozen to burst in winter.

In addition, wash water remaining in the drain channel, which is located parallel to the ground, may not be completely drained, with the result that the drain channel may be frozen to burst in winter.

Additionally, in the case in which conventional laundry treatment apparatuses are configured such that a drawer is discharged forward from a cabinet, and a tub is received in the drawer, a flow channel for discharging wash water from the tub may have a complex structure, whereby wash water may remain in the drain channel, with the result that the drain channel may be frozen to burst in winter.

Additionally, in the case in which it is necessary to minimize the volume of the drawer type laundry treatment apparatus, the drain pump may be attached to the rear surface of the drawer. In this case, the drain channel, which is connected to the drain pump, may be located relatively high, with the result that the drain channel may be frozen to burst in winter.

Additionally, in the case in which the drain channel of the drawer type laundry treatment apparatus is located higher than the bottom surface of the tub, with the result that the drain channel may be frozen to burst in winter.

Additionally, in the case in which the drawer type laundry treatment apparatus is an auxiliary laundry treatment apparatus, which assists a main laundry treatment apparatus, it is necessary to minimize the volume of the drawer type laundry treatment apparatus. In order to minimize the volume of the auxiliary laundry treatment apparatus, it is necessary to minimize the space between the bottom surface of the drawer and the cabinet. To this end, the drain pump of the auxiliary laundry treatment apparatus may not be located lower than the bottom surface of the tub but may be attached to the rear surface of the drawer. In this case, wash water may remain in the drain channel for discharging water from the tub and the drain pump, with the result that the drain channel may be frozen to burst in winter.

In addition, conventional laundry treatment apparatuses may be configured such that wash water is intentionally collected in the drain pump and the drain channel (i.e. there is a water trap in the drain pump and the drain channel) in order to prevent the introduction of bad smells from the sewer pipe to the tub. However, the water trap may be frozen to burst in winter.

Additionally, in conventional laundry treatment apparatuses, a portion of the drain pump may be located lower than the bottom surface of the tub, with the result that the drain pump may be frozen to burst in winter.

In addition, conventional laundry treatment apparatuses do not include a means for forcibly draining water remaining in the drain pump and the drain channel.

SUMMARY

In general, one innovative aspect of the subject matter described in this specification can be embodied in a laundry treatment apparatus comprising a laundry treatment apparatus including a cabinet having an opening; a drawer dischargeable from the cabinet through the opening; a receiving unit provided in the drawer for receiving water and laundry; a drain pump for discharging water from the receiving unit; a drain channel extending through a reference point set to be higher than a highest level of water that can be stored in the receiving unit, the drain channel being located outside the cabinet; and a connection channel located in the cabinet for connecting the drain pump and the drain channel to each other, wherein at least a portion of the drain pump is located lower than a bottom surface of the receiving unit.

The foregoing and other embodiments can each optionally include one or more of the following features, alone or in combination. In particular, one embodiment includes all the following features in combination. Water stored in the drain channel between a reference point set to be higher than an upper surface of the receiving unit and the drain pump flows to the drain pump by gravity. The drain pump comprises a drain chamber fixed to a rear surface of the drawer, a chamber communication pipe for allowing the drain chamber and the receiving unit to communicate with each other, an impeller provided in the drain chamber, and a motor fixed to an outside of the drain chamber for rotating the impeller, at least a portion of the drain chamber being located lower than the bottom surface of the receiving unit. A portion of the connection channel is located lower than the bottom surface of the receiving unit. The connection channel comprises: a first connection channel connected to the drain pump; and a second connection channel for connecting the first connection channel and the drain channel to each other, and a point at which the first connection channel and the second connection channel are connected to each other is located higher than the bottom surface of the receiving unit.

The point at which the first connection channel and the second connection channel are connected to each other is located higher than a reference level of water formed in the receiving unit as the water stored between the reference point and the drain pump moves to the receiving unit by gravity. The first connection channel is inclined downward from the second connection channel toward the drain pump. The laundry treatment apparatus further comprises a valve for preventing a siphon phenomenon from occurring in the drain channel. The laundry treatment apparatus further comprises a channel connection unit located at the point at which the first connection channel and the second connection channel are connected to each other for fixing the second connection channel to a rear surface of the drawer and for allowing the second connection channel to rotate about a shaft perpendicular to a bottom surface of the drawer. The laundry treatment apparatus further comprises a channel connection unit located at the point at which the first connection channel and the second connection channel are connected to each other for connecting the first connection channel and the second connection channel to each other such that one of the connection channels is rotatable in a circumferential direction of the other connection channel.

The drain pump comprises: a drain chamber fixed to a rear surface of the drawer; and a chamber communication pipe provided at a lower end of the drain pump for allowing the drain pump and the receiving unit to communicate with each other, the connection channel comprises: a first connection channel connected to the drain pump; and a second connection channel for connecting the first connection channel and the drain channel to each other, and the first connection channel is connected to the drain pump at a position higher than the bottom surface of the receiving unit and is located lower than the bottom surface of the receiving unit such that water stored between a point higher than an upper surface of the receiving unit and the drain pump flows to the drain pump by gravity. The laundry treatment apparatus further comprises a residual water drain unit for discharging wash water from the drain pump, the residual water drain unit being exposed outside the cabinet. The residual water drain unit comprises a residual water drain pipe communicating with the drain pump, the residual water drain pipe extending from the drain pump toward a front of the drawer. The drawer comprises a drawer body dischargeable from the cabinet and a drawer panel provided at the drawer body for closing the opening, and a free end of the residual water drain pipe is separably provided at the drawer body or the drawer panel.

The free end of the residual water drain pipe is separably provided at the drawer body, and the free end of the residual water drain pipe is provided with a drain pipe opening and closing part for opening and closing the residual water drain pipe. The free end of the residual water drain pipe is separably provided at the drawer body, and the drawer panel is provided with an opening and closing protrusion protruding from a rear surface of the drawer panel for opening and closing the free end of the residual water drain pipe, the free end of the residual water drain pipe being separably coupled to the opening and closing protrusion. The laundry treatment apparatus further comprises a fixed body provided at the drawer body; a fixed body through-hole formed through the fixed body for defining a space in which the residual water drain pipe is received; and a gateway for allowing the fixed body through-hole to communicate with an outside of the fixed body and for defining a passage through which the residual water drain pipe is inserted into the fixed body through-hole or is discharged from the fixed body through-hole. The laundry treatment apparatus comprises a drain pipe support part provided at the drawer body for supporting the residual water drain pipe such that the residual water drain pipe does not contact an inner circumferential surface of the cabinet.

The drawer body is further provided with an introduction aperture, the receiving unit comprises: a tub provided in the drawer body for storing wash water therein; a drum rotatably provided in the tub; and a tub introduction aperture provided in the tub for allowing the introduction aperture and the drum to communicate with each other, and the fixed body is located in a space between the drawer panel and the introduction aperture. The laundry treatment apparatus further comprises a guide comprising a first body rotatably coupled to the cabinet and a second body having one end rotatably coupled to the first body and the other end rotatably coupled to the drawer; and a water supply unit for guiding water supply from a water source to the receiving unit, the water supply unit being supported by the guide. The laundry treatment apparatus further comprises a drain connection pipe provided in the first body for defining a movement path of water, wherein the second connection channel allows the first connection channel and the drain channel to communicate with each other via the drain connection pipe. The second connection channel comprises a first drain pipe for connecting the first connection channel and the drain connection pipe to each other and a second drain pipe for connecting the drain connection pipe and the drain channel to each other. The laundry treatment apparatus further comprises a water supply connection pipe provided in the first body for defining a movement path of water, the water supply connection pipe being separate from the drain connection pipe, wherein the water supply unit comprises a first water supply channel for connecting the water supply connection pipe to the water source and a second water supply channel for guiding water in the water supply connection pipe to the receiving unit, the second water supply channel being supported by the second body. The connection channel is inclined downward toward the drain pump. The portion of the connection channel located lower than the bottom surface of the receiving unit is inclined downward toward the drain pump.

The subject matter described in this specification includes implementations that realize one or more of the following advantages. For example, a laundry treatment apparatus may drain remaining water in a drain channel when a drain pump stops while water is being drained. The laundry treatment apparatus may prevent water in the drain channel from flowing backwards or freezing in the drain channel.

The details of one or more embodiments of the subject matter of this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
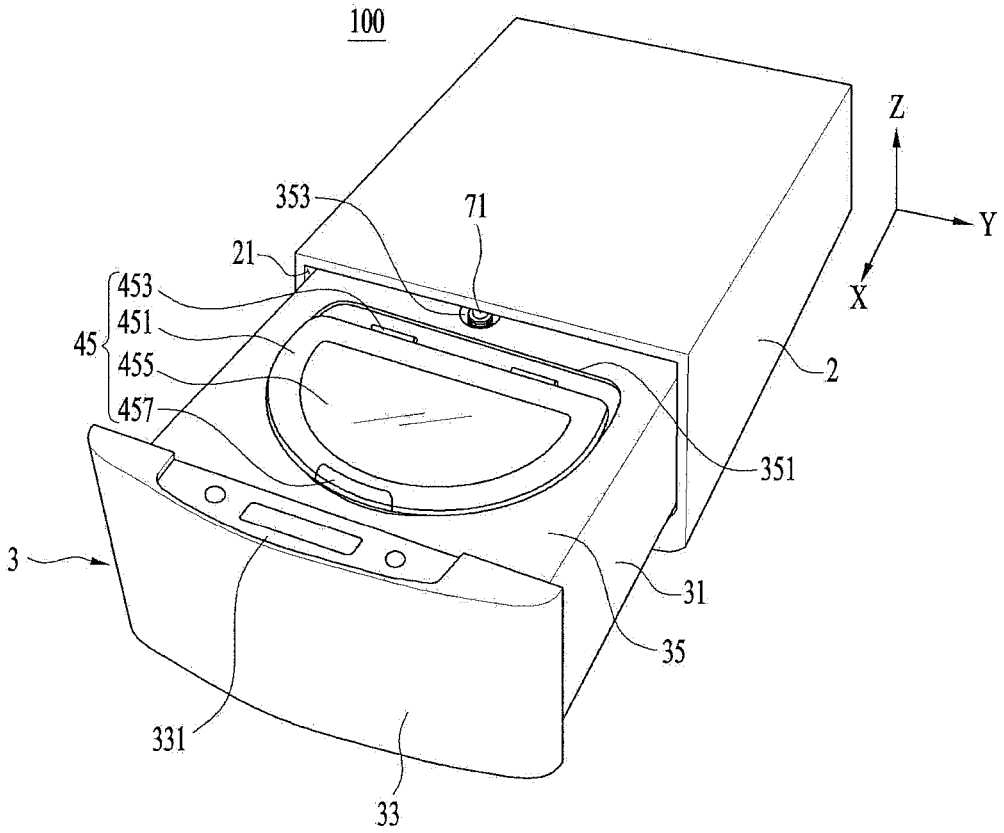
FIGS. 1 and 2 are diagrams illustrating an example laundry treatment apparatus.

FIG. 1 illustrates an example laundry treatment apparatus. In FIG. 1, a laundry treatment apparatus 100 includes a cabinet 2, a drawer 3 provided so as to be discharged from the cabinet 2, and a receiving unit 4 and 5 provided in the drawer 3 for receiving water and laundry therein.

The cabinet 2 may serve to define the external appearance of the laundry treatment apparatus 100, and may also simply serve as a space in which the drawer 3 is received. In any case, the cabinet 2 may be provided in the front surface thereof with an opening 21 for the insertion of the drawer 3.

The drawer 3 includes a drawer body 31 configured so as to be inserted into the inside of the cabinet 2 through the opening 21, a drawer panel 33 coupled to the front surface of the drawer body 31 for opening and closing the opening 21, and a drawer cover 35 for forming the upper surface of the drawer body 31.

Because the drawer panel 33 is coupled to the front surface of the drawer body 31, the drawer panel 33 may serve as a handle for discharging the drawer body 31 from the cabinet 2.

The drawer panel 33 may be provided with a control panel 331, which is used to input a control command associated with the operation of the laundry treatment apparatus 100 and to notify a user of a message associated with the operation of the laundry treatment apparatus 100.

The drawer body 31 may have any shape so long as it can be inserted into the cabinet 2 through the opening 21 and can provide a space in which the tub 4 is received. FIG. 1 illustrates a hollow drawer body 31 having a hexahedral shape by way of example.

The drawer cover 35 has a first through-hole 351 and a second through-hole 353 for communicating the inside of the drawer body 31 with the outside. The first through-hole 351 may be provided for the introduction and discharge of laundry, and the second through-hole 353 may be provided to supply water required to wash the laundry.

The laundry is introduced and discharged through the first through-hole 351, and water is supplied through the second through-hole 353. Consequently, the first through-hole 351 may be larger than the second through-hole 353.

Generally, the drawer 3 is discharged forward from the cabinet 2, and an external water source is provided at the rear of the cabinet 2. Consequently, the second through-hole 353 may be provided more rearward than the first through-hole 351.

In addition, the first through-hole 351 may have a structure including a rear straight part and curved parts provided at opposite ends of the straight part because the first through-hole 351 is opened and closed by a door, which will be described hereinafter.

For example, the first through-hole 351 may have a semicircular shape or a half-track shape.

A detailed description of the first through-hole 351 and the second through-hole 353 will follow.

Figure 2:
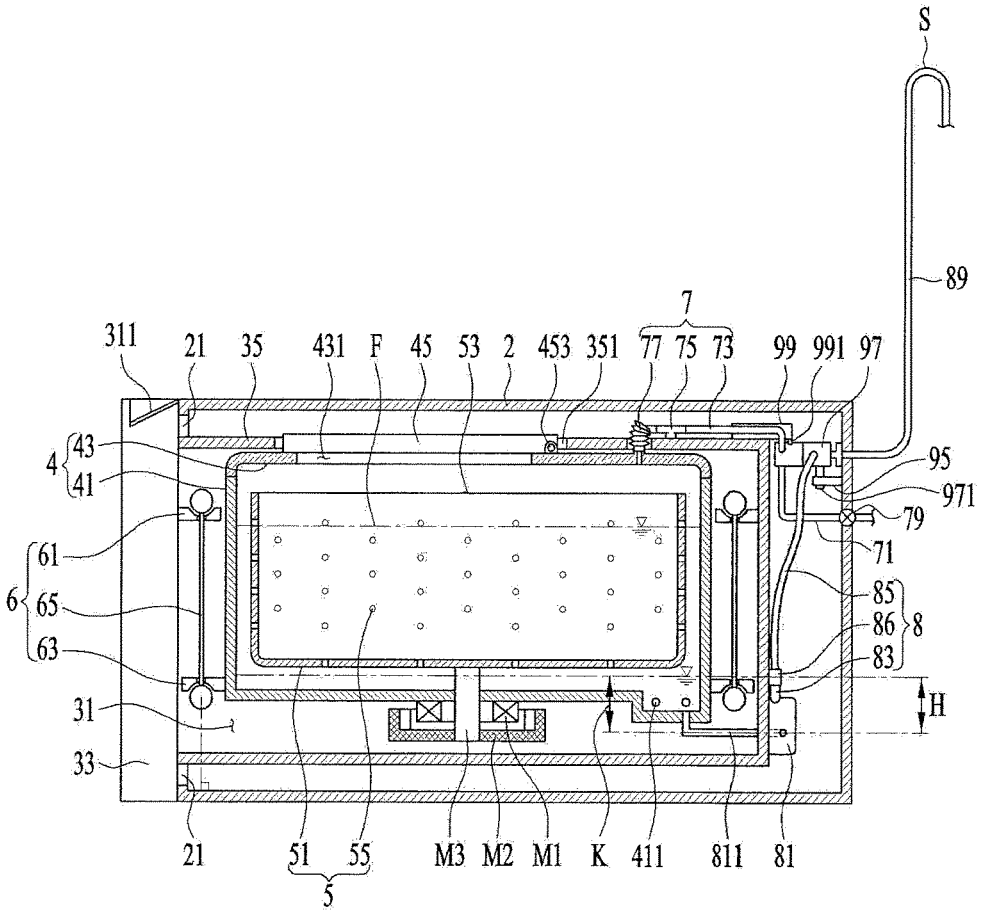

FIG. 2 illustrates an example laundry treatment apparatus. Referring to FIG. 2, the receiving unit may include a tub 4 for storing water therein and a drum 5 rotatably provided inside the tub 4 for storing laundry therein.

The tub 4 includes a tub body 41 located inside the drawer body 31 for storing water therein, and a tub cover 43 for forming the upper surface of the tub body 41. The tub body 41 may take the form of a cylinder having an open upper surface. A heater 411 for heating water may be provided in the tub body 41.

The tub cover 43 may have an introduction aperture 431 for communicating the inside of the tub body 41 with the outside of the tub body 41, and a supply aperture 433 for introducing water into the tub body 41.

The introduction aperture 431 may be provided under the first through-hole 351 provided in the drawer cover 35, and the supply aperture 433 may be provided so as to communicate with the second through-hole 353 provided in the drawer cover 35.

The introduction aperture 431 serves to allow laundry to be introduced into the tub body 41, or to allow the laundry inside the tub body 41 to be discharged to the outside of the tub body 41. The introduction aperture 431 is opened and closed by a door 45.

Figure 3:
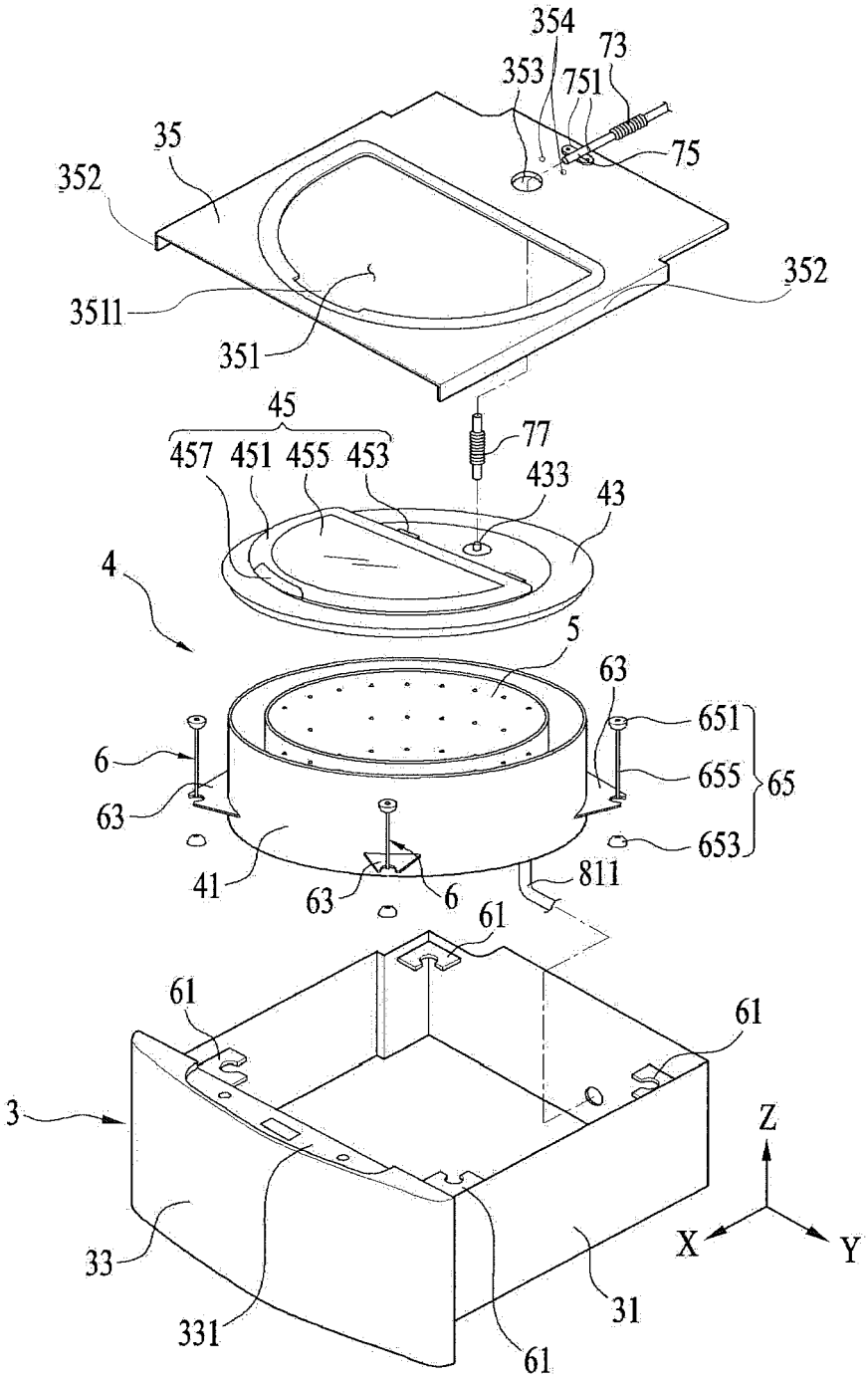
FIG. 3 is a diagram illustrating an example drawer and an example receiving unit.

FIG. 3 illustrates an example drawer and an example receiving unit. In FIG. 3, the door 45 may include a frame 451 rotatably coupled to the tub cover 43 via a hinge 453, a window 455 provided in the frame 451, and a door handle 457 for separably coupling the frame 451 to the tub cover 43.

The door 45 may be rotated upward or downward about the hinge 453 to open and close the tub cover 43.

The door 45 may be rotated only above the tub cover 43.

The reason for this is to enable a user to easily open or close the door 45 to prevent the door 45 from contacting the wash water and laundry in the tub 4.

Consequently, the door 45 may be located on the tub cover 43 in contact therewith.

That is, the door 45 may be located on the upper outer circumferential surface of the introduction aperture 431 in contact therewith.

The through-hole 351 may have the same shape as the door 45 such that the door 45 opens and closes the introduction aperture 431 while rotating about the hinge 453.

The portion of the door 45 at which the hinge 453 is mounted may be straight such that the door 45 is easily rotated about the hinge 453. The portion of the door 45 at which the hinge 453 is not mounted may be curved such that laundry is easily introduced and discharged.

That is, the curvature of the curved portion is not particularly restricted as long as the opposite ends of the curved portion are coupled to opposite ends of the straight portion.

For example, the door 45 may have a semicircular shape or a half-track shape. In this case, the through-hole 351 may have the same shape as the door 45, whereas the size of the through-hole 351 may be greater than the size of the door 45.

The through-hole 351 may be provided at the position corresponding to the door handle 457 with an incision part 3511, through which the user may more easily grip the door handle 457.

The door handle 457 may be provided on the front surface of the frame 451 such that the door 45 is uniformly opened and closed.

That is, the door handle 457 may be provided symmetrically on the front middle part of the frame 451.

The reason for this is to prevent the door 45 from being biased in the leftward direction or in the rightward direction from the door handle 457 when the door 45 is opened and closed.

The first through-hole 351 may be provided at the portion corresponding to the door handle 457 with an incision part 3511, through which the user may more easily grip the door handle 457. The drawer cover 35 may further include an extension rib 352 extending downward from opposite sides thereof.

The extension rib 352 may be coupled to the upper end of the drawer body 31 such that the drawer cover 35 is coupled to the drawer body 31.

The extension rib 352 may be provided with a plurality of holes, through which fastening members, such as bolts or nuts, may be inserted. Alternatively, the extension rib 352 may be configured to be fitted into the drawer body 31.

The fitted insertion may be achieved by a slide provided at one of the drawer body 31 and the inner surface of the extension rib 352 and a rail provided at the other of the drawer body 31 and the extension rib 352 such that the slide is coupled to the rail.

In addition, the fitted insertion may be achieved by a hook and a receiving recess.

That is, the configuration of the fitted insertion is not particularly restricted as long as the extension rib 352 is fastened to the drawer body 31.

A water supply pipe 73, which will be described hereinafter, may be provided with a fastening pipe 75, which may be fixedly fastened to the drawer cover 35.

The fastening pipe 75 may be provided at opposite ends thereof with fastening ribs 751, and the drawer cover 35 may further include fastening recesses 354, to which the fastening ribs 751 are fastened.

The fastening pipe 75 may stably fix the water supply pipe 73 when the drawer 3 is vibrated due to vibration of the rub 4.

In addition, the fastening pipe 75 may stably support the water supply pipe 73 when the drawer 3 is moved forward and rearward, thereby preventing the water supply pipe 73 from being broken.

The window 455 may be formed of a transparent material to allow the user to view the inside of the tub body 41 when the drawer 3 is discharged from the cabinet 2.

The tub 4 having the configuration described above is coupled to the drawer body 31 via a tub support unit 6. The tub support unit 6 may include a first support member 61 provided at the drawer body 31, a second support member 63 provided at the tub body 41, and a connector 65 for connecting the first support member 61 and the second support member 63 to each other.

The connector 65 may include a first connection piece 651 configured so as to be seated in the first support member 61, a second connection piece 653 for supporting the second support member 63, and a bar 655 for coupling the first connection piece 651 and the second connection piece 653 to each other.

The first connection piece 651 may be shaped so as to be movable in the first support member 61 while being seated in the first support member 61. The second connection piece 653 may be shaped so as to support the second support member 63 and to be movable in the second support member 63.

Referring to FIG. 2, the first connection piece 651 and the second connection piece 653 have spherical shapes. In addition, referring to FIG. 3, the first connection piece 651 and the second connection piece 653 have semispherical surfaces in contact with the respective support members 61 and 63 by way of example.

In some implementations, as exemplarily illustrated in FIG. 2, the bar 655 may form a right angle with respect to the bottom surface of the cabinet 2 (i.e. may be provided parallel to the height direction Z of the cabinet 2 or provided so as to be orthogonal to the bottom surface of the drawer 3).

Because at least three tub support units 6 are provided to couple the tub body 41 to the drawer body 31 and the bars 655 form a right angle with respect to the bottom surface of the cabinet 2, the distance between the tub cover 43 and the drawer cover 35 may be increased compared to the case where the bars 655 are tilted at a prescribed angle relative to the Z-axis.

Accordingly, the tub support units 6 may reduce the possibility of the tub cover 43 colliding with the drawer cover 35 even if the tub body 41 vibrates inside the drawer body 31.

The drum 5, which is provided inside the tub 4, may include a cylindrical drum body 51 having an opening 53 formed in the upper surface thereof. Because the opening 53 is located below the introduction aperture 431, the laundry supplied through the introduction aperture 431 may be supplied to the drum body 51 through the opening 53.

In some implementations, a plurality of drum through-holes 55 may be provided in the bottom surface and the circumferential surface of the drum body 51 for communicating the inside of the drum body 51 with the tub body 41.

The drum body 51 may be rotated inside the tub body 41 by a drive unit. The drive unit may include a stator M1 located outside the tub body 41 and coupled to the bottom surface of the tub body 41, a rotor M2 configured so as to be rotated by a rotating magnetic field provided by the stator M1, and a rotating shaft M3 penetrating the bottom surface of the tub body 41 for coupling the bottom surface 57 of the drum 5 and the rotor M3 to each other. The rotating shaft M3 may be provided so as to form a right angle with respect to the bottom surface of the tub body 41.

The laundry treatment apparatus 100 having the configuration described above may supply water to the tub 4 via a water supply unit 7, and may discharge the water stored in the tub 4 to the outside of the cabinet 2 via a drain unit 8.

In some implementations, the laundry treatment apparatus 100 is configured such that the drawer 3 can be discharged from the cabinet 2. For example, when the water supply unit 7 and the drain unit 8 simply include a hose for coupling the supply aperture 433 to a water source and a hose for guiding the water in the tub out of the cabinet, the water supply unit 7 and the drain unit 8 may be entangled or twisted when the drawer 3 is discharged from or inserted into the cabinet 2.

In order to prevent this, the laundry treatment apparatus 100 further includes a guide 9 provided in the cabinet 2 for guiding the movement of the water supply unit 7 and the drain unit 8.

Figure 4:
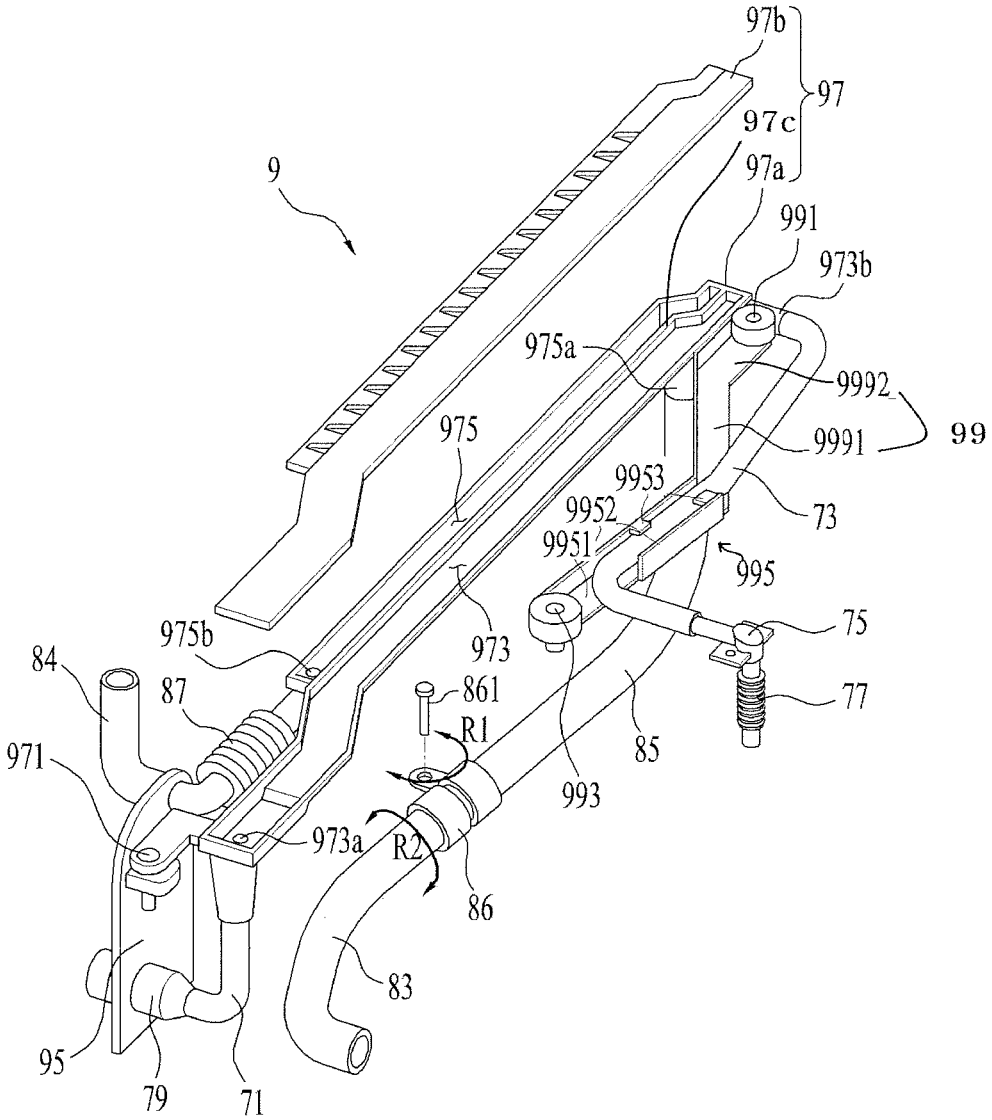
FIG. 4 is a diagram illustrating an example guide, an example water supply unit, and an example drain unit.

FIG. 4 illustrates an example guide, an example water supply unit, and an example drain unit. In FIG. 4, the guide 9 may include a first body 97 rotatably provided in the cabinet 2 and a second body 99 rotatably coupled to the first body 97 and the drawer 3.

The first body 97 may include a support part 95 coupled to the cabinet 2, a base 97*a* rotatably coupled to the support part 95, and a cover 97*b* coupled to the base 97*a* for forming the upper surface of the first body 97.

The base 97*a* is coupled to the support part 95 via a first shaft 971. Consequently, the first body 97 may be rotated about the first shaft 971.

The base 97*a* is provided with a water supply connection pipe 973 and a drain connection pipe 975, which are separated from each other by a partition wall 97*c*. The water supply connection pipe 973 is a flow channel constituting the water supply unit 7, and the drain connection pipe 975 is a flow channel constituting the drain unit 8.

The second body 99, which is formed in the shape of a bar, supports a portion 93 of the water supply unit 7. One end of the second body 99 is rotatably coupled to the first body 97 via a second shaft 991, and the other end of the second body 99 is rotatably coupled to the drawer cover 35 via a third shaft 993.

For example, when the guide 9 is provided as described above, the water supply unit 7 may include a first water supply channel 71 for coupling the water supply connection pipe 973 to the water source and a second water supply channel 73 and 77 for coupling the water supply connection pipe 973 to the supply aperture 433 provided in the tub 4.

The first water supply channel 71 is opened and closed by a water supply valve 79. The first water supply channel 71 communicates with the water supply connection pipe 973 via an inlet 973*a* of the water supply connection pipe.

The second water supply channel may include a fastening pipe 75 coupled to the drawer cover 35, a first water supply pipe 73 for coupling the fastening pipe 75 to an outlet 973*b* of the water supply connection pipe, and a second water supply pipe 77 for coupling the fastening pipe 75 to the supply aperture 433 provided in the tub 4. The fastening pipe 75 fixes the first water supply pipe 73 to the drawer cover 35 and, in addition, allows the first water supply pipe 73 and the second water supply pipe 77 to communicate with each other.

The first water supply pipe 73 and the second water supply pipe 77 may be bent at the fastening pipe 75.

The first water supply pipe 73 is coupled to the drawer cover 35 so as to effectively supply wash water into the tub 4 and the drum 5, which are received in the drawer 3.

The second water supply pipe 77 may be bent downward at the fastening pipe 75 so as to be directed toward the lower part of the tub 4. As a result, wash water is supplied from the second water supply pipe 77 in a uniform direction, thereby securing reliability in supply of wash water. The first water supply pipe 73 may be separably mounted to the second body 99. To this end, the second body 99 may further include a water supply pipe receiving unit 995 for receiving the first water supply pipe 73.

The water supply pipe receiving unit 995 may include a base 9951 extending from the lower part of the third shaft 993, receiving ribs 9952 extending upward from opposite ends of the base 9951, and protrusions 9953 protruding from the free ends of the receiving ribs 9952 so as to be close to each other in the state in which the protrusions 9953 are in parallel to the base 9951.

The water supply pipe receiving unit 995 may be open at the upper surface thereof.

The base 9951 and the receiving ribs 9952 may fixedly receive the first water supply pipe 73, and the protrusions 9953 may prevent the first water supply pipe 73 from being separated or dislocated due to external impact.

The second body 99 may include an inclined part 9991 coupled to the second shaft 991 while being spaced apart from the first body 97.

The inclined part 9991 may maintain the distance between the first body 97 and the second body 99 to prevent a collision between the first body 97 and the second body 99 and thus damage to the first body 97 and the second body 99 when the tub 4 is vibrated.

In addition, the length of the water supply pipes 73 and 77 extending from the second body 99 to the second through-hole 353 may be minimized, thereby maximizing stability.

The second body 99 may further include a first straight part 9992 provided parallel to the first body 97. The inclined part 9991 may extend from the end of the first straight part 9992.

The water supply pipe receiving unit 995 may extend from the end of the inclined part 9991.

When the drum 5 is rotated by a driving unit, the tub 4 may vibrate. When the vibration of the tub 4 is transmitted to the second water supply pipe 77, the durability of the water supply unit 7 and the guide 9 may be reduced. For this reason, the second water supply pipe 77 may be a corrugated pipe in order to prevent the vibration of the tub 4 from being transmitted to the fastening pipe 75

In the water supply unit 7, when a controller controls the water supply valve 79 to open the first water supply channel 71, water from the water source is supplied to the water supply connection pipe 973 through the first water supply channel 71, and the water, introduced into the water supply connection pipe 973, is supplied to the tub 4 through the first water supply pipe 73, the fastening pipe 75, the second water supply pipe 77, and the supply aperture 433.

Figure 5:
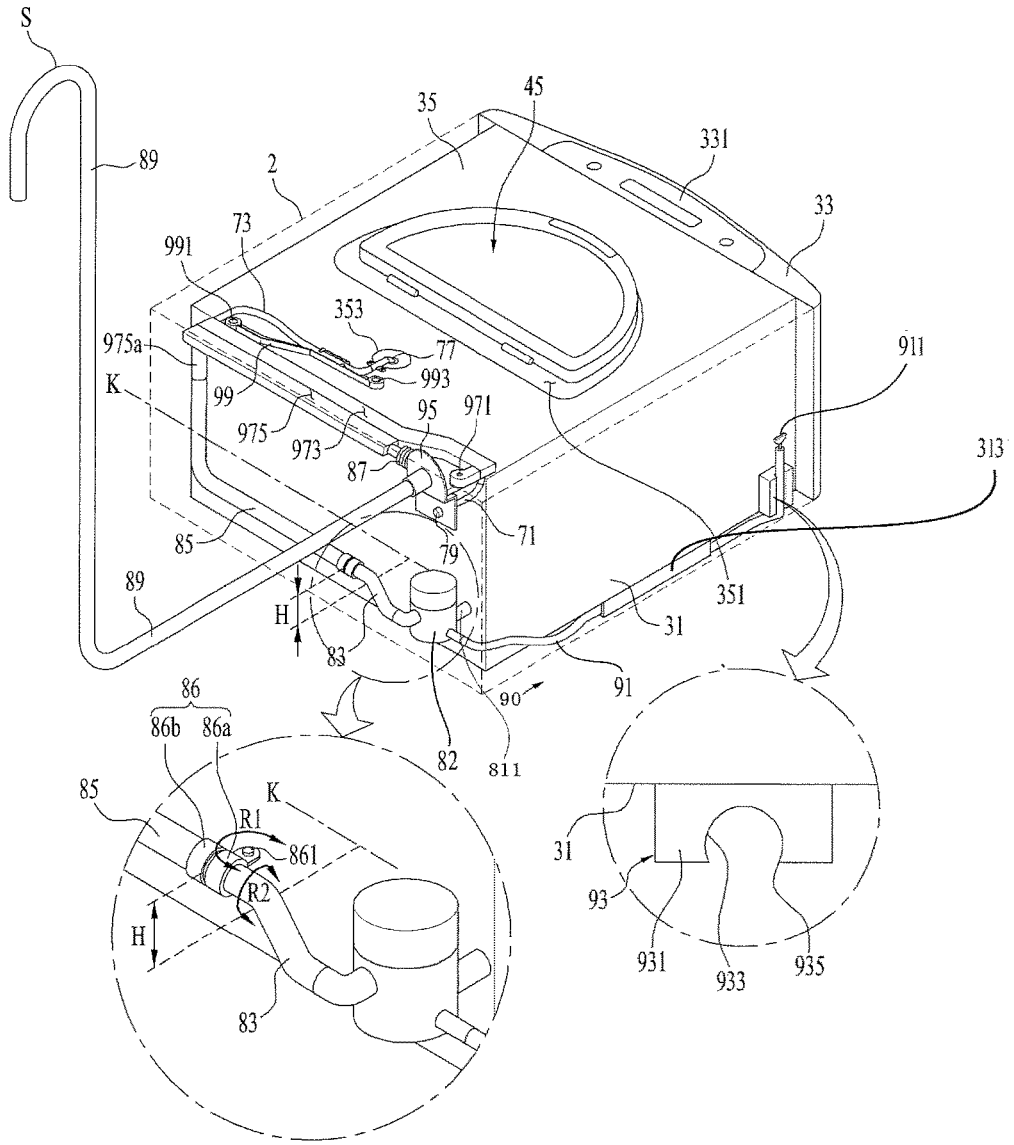
FIGS. 5 and 6 are diagrams illustrating an example laundry treatment apparatus when a drawer is in a first position.

FIG. 5 illustrates an example laundry treatment apparatus when a drawer is in a first position. In FIG. 5, the drain unit 8 may include a drain pump 82 coupled to the rear surface of the drawer 3 for discharging water from the tub 4, a drain channel 89 provided so as to extend through a reference point S higher than the highest level F, as referred in FIG. 2, of the water that can be stored in the tub, and connection channels 83, 85, and 87 for coupling the drain pump 82 and the drain channel 89 to each other.

In the drain unit 8 having the configuration described above, all or some of the connection channels may be located at a higher position H than the level (a reference level) K of water in the tub 4 formed as the water stored between the reference point S and the drain pump 82 moves to the tub 4 by gravity.

A reference position at which the level K of water in the tub is measured is identical to a reference position at which the height H of the connection channels is measured. FIG. 5 illustrates the case in which the reference position is a chamber connection pipe 811 by way of example.

When the operation of the drain pump 82 is stopped, water in the drain channel 89 between the reference point S and the drain pump 82 flows into the tub 4 by gravity. When the level K of water introduced into the tub is higher than some 83 and 85 of the connection channels, the water may remain in the connection channels.

For example, when the water remains in the connection channels, the water may be frozen in the connection channels when the temperature of external air is low as in winter. When the drawer 3 is discharged from the cabinet 2, the connection channels may be broken during movement of the drawer 3 if the connection channels are frozen.

In order to prevent this, at least one connection channel is at a higher position H than the reference water level K or some of the connection channels are provided higher than the reference water level K.

In some implementations, some connection channels are provided higher than the reference water level K and other connection channels are provided lower than the reference water level K. In this case, in order to minimize the possibility of the connection channels being broken, the length of the connection channels provided higher than the reference water level K may be greater than the length of the connection channels provided lower than the reference water level K.

In addition, in order to concentrate the water remaining in the connection channels in the drain pump (in order to minimize the possibility of breakage of the connection channels), all of the connection channels or the connection channels provided lower than the reference water level K may be inclined downward toward the drain pump.

The position at which the connection channels are arranged in order to obtain the above effects may be set in consideration of the height of the reference point S, the volume of water that can be stored between the reference point S and the drain pump 82 based on the diameter of the channels, and the level K of water that flows backward to the tub, which may be changed based on the area of the bottom surface of the tub 4.

In some implementations, a siphon phenomenon may occur in the drain channel 89 during the operation of the drain pump 82. When the siphon phenomenon occurs in the drain channel 89, water may be prevented from remaining in the drain channel and the connection channels as well as the tub 4, thereby solving the problem of water remaining in the connection channels. Generally, however, the drain channel 89 is coupled to the sewer pipe. If there is no water trap (water for preventing external air from being introduced into the tub through the drain channel) in the connection channels, therefore, bad smells from the sewer pipe may be introduced into the tub 4.

Consequently, the laundry treatment apparatus may further include a valve for preventing a siphon phenomenon from occurring in the drain channel 89 when the operation of the drain pump 82 is stopped.

In some implementations, the drain pump 82 may include a drain chamber 81 coupled to the rear surface of the drawer 3, a chamber connection pipe 811 for allowing the drain chamber 81 and the tub 4 to communicate with each other, an impeller provided in the drain chamber 81, and a motor coupled to the outside of the drain chamber 81 for rotating the impeller.

The chamber connection pipe 811 extends through the rear surface of the drawer so as to be coupled to the tub body 41. When the impeller is rotated, therefore, water in the tub may be introduced into the drain chamber 81 through the chamber connection pipe 811.

The connection channels may include a first connection channel 83 coupled to the drain chamber 81 and second connection channels 85 and 87 for coupling the first connection channel 83 and the drain channel 89 to each other through the drain connection pipe 975, provided in the guide 9.

In this case, the first connection channel 83 may be parallel to the bottom surface of the drawer (a dotted line in the enlarged view) or may be inclined downward from the second connection channels toward the drain chamber 81. For example, when the first connection channel 83 is inclined downward from the second connection channels toward the drain chamber 81, the water remaining in the second connection channels 85 and 87 may move to the drain pump 82.

For example, when the first connection channel 83 is inclined, the point (the coupling point) at which the first connection channel 83 is coupled to the second connection channels may be located at a higher position H than the level K of water in the tub 4 formed as the water stored between the reference point S and the drain pump 82 moves to the tub 4 by gravity.

In some implementations, referring to FIGS. 4 and 5, the laundry treatment apparatus may further include a channel coupling unit 86 for fixing the position of the coupling point such that the coupling point is coupled to a higher position H than the level K of water in the tub and such that the first connection channel 83 is maintained inclined downward to the drain pump 82. That is, the channel coupling unit 86 fixes the coupling point to the rear surface of the drawer 3.

The channel coupling unit 86 may rotatably fix the connection channels to the rear of the drawer 3. That is, the channel coupling unit 86 may fix the connection channels to the rear of the drawer 3 such that the connection channels can be rotated about a shaft (a coupling unit support shaft) 861 perpendicular to the bottom surface of the drawer 3 (R1).

In addition, when the drawer 3 is discharged from the cabinet 2, the coupling point of the first connection channel 83 and the second connection channels may be twisted. In order to prevent this, the channel coupling unit 86 may include a first fastening part 86*a* provided in the first connection channel 83 and a second fastening part 86*b* provided in the second connection channels so as to be rotatably coupled to the first fastening part.

In this case, one of the connection channels may be rotated along the circumferential direction R2 of the other connection channel. Consequently, it is possible to prevent the reduction in durability of the connection channels due to the twisting of the coupling point occurring when the drawer is discharged from the cabinet or is inserted into the cabinet.

The coupling unit support shaft 861 may be provided in one of the first fastening part 86*a* and the second fastening part 86*b*.

In some implementations, the second connection channels 85 and 87 may include a first drain pipe 85 for coupling the first connection channel 83 and the drain connection pipe 975 to each other and a second drain pipe 87 for coupling the drain connection pipe 975 and the drain channel 89 to each other.

The first drain pipe 85 may be coupled to the drain connection pipe 975 via an inlet 975*a* of the drain connection pipe and may be coupled to the first connection channel 83 via the second fastening part 86*b*. The second drain pipe 87 may be coupled to the drain connection pipe 975 via an outlet 975*b* of the drain connection pipe.

The first connection channel 83 and the first drain pipe 85 may be constituted by a single hose. In this case, the first connection channel and the first drain pipe may be distinguished from each other based on the position of the coupling point.

Because the point at which the second drain pipe 87 is coupled to the drain channel 89 is different from the center of rotation of the first body 97, the second drain pipe 87 may be made of an elastic material (for example, rubber) or may be a corrugated pipe that is capable of expanding and contracting in the longitudinal direction.

Figure 6:
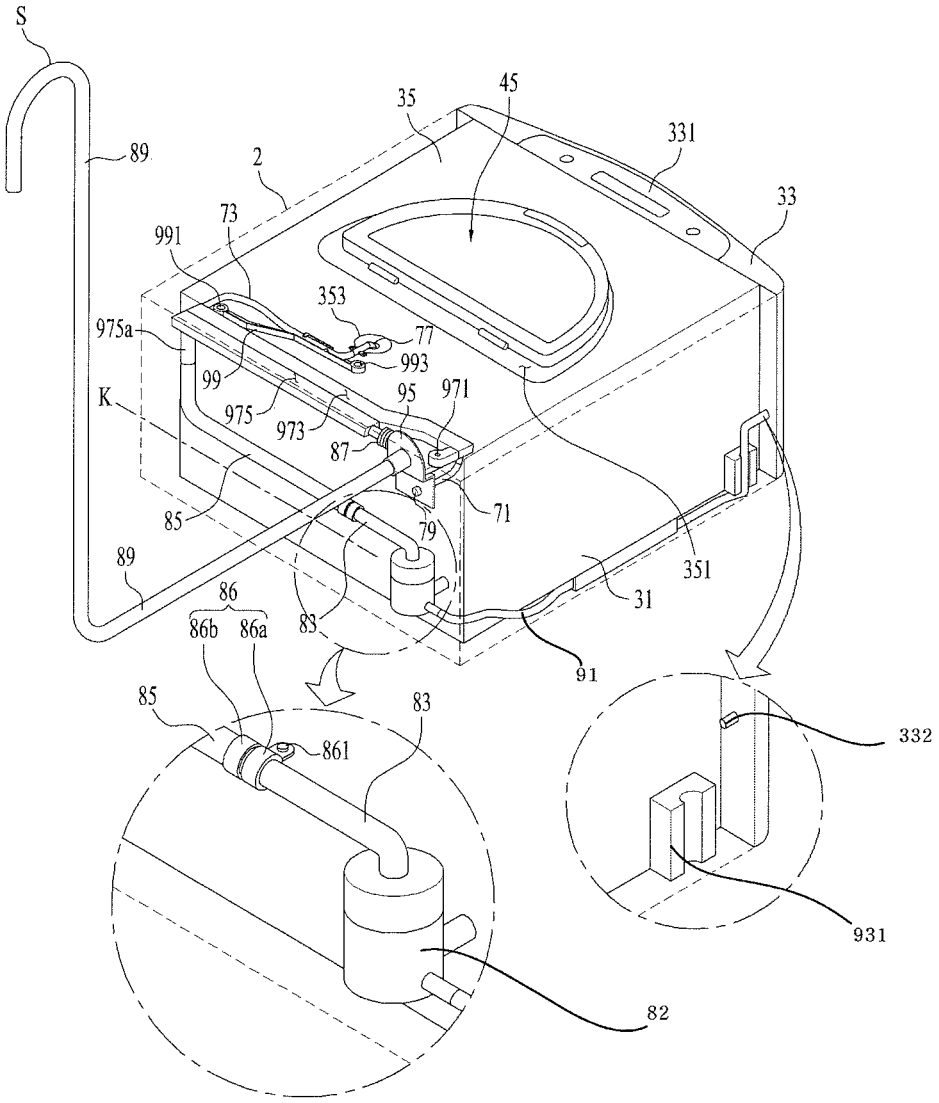

FIG. 6 illustrates an example laundry treatment apparatus when a drawer is in a first position. For example, the first position may indicate a position when the drawer is closed.

In the laundry treatment apparatus, the tub 4 and the drum 5 may be referred to as a receiving unit 4 and 5.

The drum 5 may be received in the tub 4, and the upper surface and the lower surface of the tub 4 may be located more outward than the upper surface and the lower surface of the drum 5. In this case, the receiving unit may be defined as the tub 4.

The drain channel 89 may extend through a higher point than the upper surface of the receiving unit 4, and may be located outside the cabinet 2.

The connection channels 83, 85, and 87 may be located in the cabinet, and may couple the drain pump 82 and the drain channel 89 to each other.

The drain pump 82 may have a region protruding more downward than the bottom surface of the receiving unit 4. That is, at least a portion of the drain pump 82 may be located lower than the bottom surface of the receiving unit 4.

In this case, at least a portion of the drain chamber 81 may be located lower than the bottom surface of the receiving unit 4.

In other words, at least a portion of the drain pump 82 may be located lower than the bottom surface of the tub 4.

When the operation of the drain pump 82 is stopped, therefore, water stored between the reference point S, which is set to be higher than the upper surface of the receiving unit 4, and the drain pump 82 flows to the drain pump 82 by gravity and is collected in the drain pump 82.

That is, the wash water in the receiving unit 4 may be collected in the region of the drain pump 82 that is lower than the bottom surface of the receiving unit 4 and 5.

In addition, the water stored between the point higher than the upper surface of the receiving unit 4 or the maximum level of water that can be received in the receiving unit 4 and the drain pump 82 may move to the drain pump 82 by gravity.

Some of the connection channels 83, 85, and 87 may be located lower than the bottom surface of the receiving unit 4 such that the water stored between the point higher than the upper surface of the receiving unit 4 and the drain pump can move to the drain pump 82 by gravity.

That is, the connection channels may include a first connection channel 83 coupled to the drain pump 82 and a second connection channel 85 for coupling the first connection channel 83 and the drain channel 89 to each other. The point at which the first connection channel 83 and the second connection channel 85 are coupled to each other may be higher than the bottom surface of the receiving unit 4.

Figure 7:
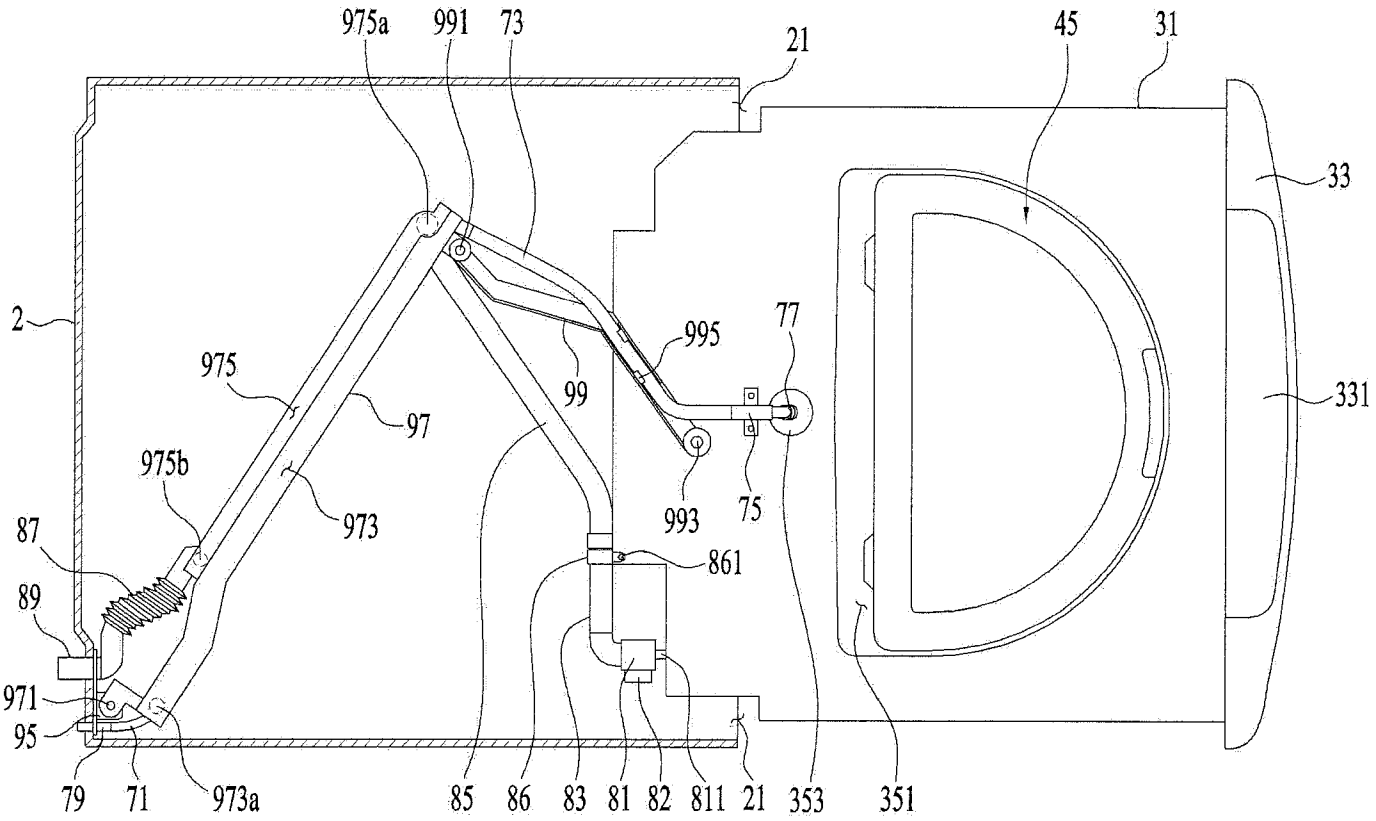
FIG. 7 is a diagram illustrating an example laundry treatment machine when a drawer is in a second position.

FIG. 7 illustrates an example laundry treatment machine when a drawer is in a second position. For example, the second position may indicate a position when the drawer is open.

The chamber connection pipe 811 may be coupled to the drain pump 82 at a lower position than the bottom surface of the receiving unit 4.

The connection channels may include a first connection channel 83 coupled to the drain pump 82 and a second connection channel 85 for coupling the first connection channel 83 and the drain channel 89 to each other. The first connection channel 83 may be coupled to the drain pump 82 at a higher position than the bottom surface of the receiving unit 4.

For example, when the first connection channel 83 is not provided lower than the bottom surface of the receiving unit 4, therefore, the wash water in the first connection channel 83 may be collected in the drain pump 82 by gravity.

Specifically, for example, when a portion of the drain pump 82 is provided lower than the bottom surface of the receiving unit, the first connection channel 83 may be coupled to the upper end of the drain pump 82, and the chamber connection pipe 811 may be coupled to the lower end of the drain pump 82.

When the operation of the drain pump 82 is stopped, therefore, the wash water in the first connection channel 83 may be collected in the drain pump 82 by gravity.

Referring back to FIG. 6, an example method of discharging residual water collected in the drain pump 82 is described with reference to FIG. 6.

In order to prevent wash water supplied to the tub body 41 from being discharged out of the tub body 41 through the drain channel 89 even though the drain pump 82 provided in the drain unit 8 is not operated, it is necessary for the drain channel 89 to be located higher than the highest level of wash water that can be stored in the tub body 41.

In this case, the second connection channel 85 coupled to the drain channel 89 extends from under the guide 9 toward the guide 9. When the operation of the impeller is stopped by the drain pump 92 of the drain unit 8, air is introduced from the tub body 41 into the drain channel 89 through the second water supply channel 73, whereby no siphon phenomenon occurs in the drain channel 89. Consequently, the wash water that is lower than the position at which the second water supply channel 73 is coupled to the second connection channel 85 may remain in the second connection channel 85.

When the wash water remains in the second connection channel 85, bad smells from the sewer pipe are prevented from being introduced into the tub body 41 through the drain channel 89. In winter, however, the second connection channel 85 may be frozen to burst. As needed, therefore, it is necessary to drain even the wash water in the second connection channel 85. To this end, the laundry treatment apparatus may further include a residual water drain unit 90.

Referring to FIG. 6, the residual water drain unit 90 may include a residual water drain pipe 91 communicating with the drain pump 82 and configured to be exposed outside the cabinet 2 when the drawer is discharged from the cabinet 2.

The fixed end of the residual water drain pipe 91 may communicate with one side of the drain pump 82, and the free end of the residual water drain pipe 91 may be separably coupled to the drawer body 31. The free end of the residual water drain pipe 91 is provided with a drain pipe opening and closing part 911 for opening and closing the residual water drain pipe 91.

In some implementations, in order to separably fix the free end of the residual water drain pipe 91 to the drawer body 31, the residual water drain unit 90 may further include a drain pipe attaching and detaching part 93 provided in the drawer body 31.

The drain pipe attaching and detaching part 93 is provided in the drawer body 31 so as to be adjacent to the rear of the drawer panel 33 (so as to be adjacent to the opening 21).

That is, the drain pipe attaching and detaching part 93 may include a fixed body 931 coupled to the drawer body 31 so as to be located between the rear surface of the drawer panel 33 and the introduction aperture 353, a fixed body through-hole 933 formed through the fixed body 931, and a gateway 935 formed by incision in the fixed body 931 such that the fixed body through-hole 933 communicates with the outside of the fixed body 931.

The diameter of the fixed body through-hole 933 is greater than the diameter of the residual water drain pipe 91, and the width of the gateway 935 is less than the diameter of the residual water drain pipe 91.

Consequently, the user may insert the residual water drain pipe 91 into the fixed body through-hole 933 through the gateway 935 or may be discharge the residual water drain pipe 91 from the fixed body through-hole 933 through the gateway 935.

In some implementations, in order to prevent the residual water drain pipe 91 from becoming entangled in the cabinet 2 or from interfering with the devices provided in the cabinet 2 when the drawer 3 is discharged from the cabinet 2, the drawer body 31 may be further provided with a drain pipe support part 313 for preventing the residual water drain pipe 91 from contacting the inner circumferential surface of the cabinet 2. FIGS. 5 and 6 illustrate an example that the drain pipe support part 313 is provided under the drawer body 31 by way of example.

In order to more efficiently discharge wash water remaining in the second connection channel 85 and the drain pump 82 through the residual water drain pipe 91, the distance between the bottom surface of the drawer body 31 and the second connection channel 85 may be gradually decreased toward the drain pump 82. That is, the second connection channel 85 may be inclined downward toward the drain pump 82.

Because at least a portion of the drain pump 82 is located under the bottom surface of the receiving unit (the tub and the drum), the residual water drain pipe 91 may be coupled to one surface of the drain pump 82 located under the bottom surface of the receiving unit. In addition, the residual water drain pipe 91 may be coupled to the drain pump 82 under the drain pump 82.

As a result, wash water collected in the drain pump 82 may be discharged from the cabinet 2 through the residual water drain pipe 91.

In addition, the drawer body 33 may be further provided with an opening and closing protrusion 332 protruding from the rear surface of the drawer body 33 for opening and closing the free end of the residual water drain pipe 91. The free end of the residual water drain pipe 91 may be coupled to the drawer panel 331 by insertion of the opening and closing protrusion 332 into the free end of the residual water drain pipe 91.

Consequently, the drain pipe attaching and detaching part 93 may be omitted, thereby further increasing the volume of the drawer 3.

In addition, the drain pipe opening and closing part 911 may be omitted, thereby simplifying the laundry treatment apparatus.

Hereinafter, the operation of the drawer 3 will be described with reference to FIGS. 5 to 7.

Referring to FIG. 5, the drawer 3 is located in the cabinet 2 before laundry is introduced into the laundry treatment apparatus.

In order to introduce laundry into the receiving unit 4 and 5, provided in the drawer 3, the user discharges the drawer body 31 from the cabinet 2 through the drawer panel 33.

When the drawer body 31 is discharged from the cabinet 2, referring to FIG. 7, the first body 97 is rotated about the first shaft 971 in the direction in which the drawer body 31 is discharged, and the second body 99 maintains the state in which the first body 97 and the drawer cover 35 are coupled through the second shaft 991 and the third shaft 993.

In some implementations, the first water supply pipe 73, provided in the water supply unit 7, is supported by the second body 99. When the drawer 3 is discharged from the cabinet 2, therefore, the water supply unit 7 may be prevented from being twisted or damaged by the devices provided in the cabinet 2.

In addition, the first drain pipe 85, provided in the drain unit 8, is coupled to the drain channel 89 through the drain connection pipe 975, provided in the guide 9. When the drawer 3 is discharged from the cabinet 2, therefore, the drain unit 8 may be prevented from being twisted or damaged.

In addition, when the drawer 3 is discharged from the cabinet 2 or when drawer 3 is inserted into the cabinet 2, external force, such as twisting force, may be applied to the coupling point of the first connection channel 83 and the first drain pipe 85. The connection channel may be rotated (R1) about the coupling unit support shaft 861, thereby preventing the reduction in durability of the connection channel (in an example in which the first connection channel and the first drain pipe are constituted by a single hose).

For example, when the first connection channel 83 and the first drain pipe 85 are constituted by two hoses, which are coupled to each other via the channel coupling unit 86, the first drain pipe 85 may be rotated (R1) about the coupling unit support shaft 861 and may be rotated (R2) in the circumferential direction of the first connection channel 83, thereby preventing the reduction in durability of the connection channel.

As is apparent from the above description, the present invention has the effect of providing a laundry treatment apparatus, which may prevent a water supply unit, for supplying water to a receiving unit for receiving water and laundry, and a drain unit, for discharging water from the receiving unit out of the laundry treatment apparatus, from becoming entangled or twisted.

In addition, the present invention has the effect of providing a laundry treatment apparatus, which may prevent water from remaining in a drain unit or minimize the amount of water remaining in a drain unit.

In addition, the present invention has the effect of providing a laundry treatment apparatus, which may completely drain water remaining in a drain unit as needed.

In addition, the present invention has the effect of providing a laundry treatment apparatus, which may prevent wash water from remaining in a drain channel even in the case in which the drain channel is located parallel to the ground, thereby preventing the drain channel from being frozen to burst in winter.

In addition, the present invention has the effect of providing a laundry treatment apparatus, which may collect wash water in a drain unit to a drain pump, thereby easily managing remaining wash water.

In addition, the present invention has the effect of providing a laundry treatment apparatus, which may completely drain water in a drain pump as needed, preventing the drain pump from being frozen to burst in winter.

In addition, the present invention has the effect of providing a laundry treatment apparatus, which may completely drain wash water collected in a drain unit.

In addition, the present invention has the effect of providing a laundry treatment apparatus, which may prevent wash water from being collected in a portion of a drain channel of a drain unit that is located parallel to the ground, thereby preventing the drain channel from being frozen to burst in winter.

In addition, the present invention has the effect of providing a laundry treatment apparatus, which may completely drain wash water remaining in a drain channel that is located parallel to the ground.

In addition, the present invention has the effect of providing a laundry treatment apparatus, which may include a drawer discharged forward from a cabinet and a tub received in the drawer and which may be configured such that a drain channel is prevented from being frozen to burst in winter even in the case in which a flow channel for discharging wash water from the tub has a complex structure, whereby wash water may remain in the drain channel.

In addition, the present invention has the effect of providing a laundry treatment apparatus, which may be a drawer type laundry treatment apparatus and which may be configured such that a drain pump is attached to the rear surface of a drawer in order to minimize the volume of the drawer type laundry treatment apparatus and such that a drain channel connected to the drain pump is prevented from being frozen to burst in winter even in the case in which the drain channel is located relatively high.

In addition, the present invention has the effect of providing a laundry treatment apparatus, which may be a drawer type laundry treatment apparatus and which may be configured such that, even in the case in which a drain channel of the drawer type laundry treatment apparatus is located higher than the bottom surface of a tub, wash water in the drain channel is collected in a drain pump, thereby preventing the drain channel from being frozen to burst in winter.

In addition, the present invention has the effect of providing a laundry treatment apparatus, which may be an auxiliary drawer type laundry treatment apparatus, which assists a main laundry treatment apparatus and which may be configured such that wash water remaining in a drain channel is minimized even in the case in which a drain pump is provided at the rear surface of the drawer, thereby preventing the drain channel from being frozen to burst in winter.

In addition, the present invention has the effect of providing a laundry treatment apparatus, which may prevent a water trap from being frozen to burst in winter.

In addition, the present invention has the effect of providing a laundry treatment apparatus, which may forcibly drain water remaining in a drain pump and a drain channel.

The invention claimed is:

1. A laundry treatment apparatus comprising:

a cabinet having an opening;

a drawer configured to be withdrawn from the cabinet through the opening;

a tub located in the drawer for receiving water and laundry;

a drain pump configured to discharge water from the tub;

a drain channel that extends to an outside of the cabinet;

a connection channel that is located in the cabinet and that connects the drain pump and the drain channel to each other; and a channel connection unit located higher than a bottom surface of the tub and configured to fix the connection channel to a rear surface of the drawer, wherein a portion of the drain pump is located lower than the bottom surface of the tub, wherein a remaining portion of the drain pump is located higher than the bottom surface of the tub, wherein the connection channel includes (i) a first connection channel that connects the drain pump to the channel connection unit and (ii) a second connection channel that connects the first connection channel to the drain channel, wherein the second connection channel is located at a position higher than the bottom surface of the tub, and wherein a portion of the first connection channel is located at a position lower than the bottom surface of the tub.

2. The laundry treatment apparatus according to claim 1, wherein water stored in the drain channel between a reference point set to be higher than an upper surface of the tub and the drain pump flows to the drain pump by gravity.

3. The laundry treatment apparatus according to claim 2, wherein the drain pump comprises a drain chamber fixed to the rear surface of the drawer, a chamber communication pipe for allowing the drain chamber and the tub to communicate with each other, an impeller provided in the drain chamber, and a motor fixed to an outside of the drain chamber for rotating the impeller, at least a portion of the drain chamber being located lower than the bottom surface of the tub.

4. The laundry treatment apparatus according to claim 1, wherein a point at which the first connection channel and the second connection channel are connected to each other is located higher than the bottom surface of the tub.

5. The laundry treatment apparatus according to claim 4, wherein the point at which the first connection channel and the second connection channel are connected to each other is located higher than a reference level of water formed in the tub as the water stored between the reference point and the drain pump moves to the tub by gravity, wherein the reference level is the water level when the water inside the drain channel is introduced into the tub after the operation of the pump is stopped.

6. The laundry treatment apparatus according to claim 5, wherein the first connection channel is inclined downward from the second connection channel toward the drain pump.

7. The laundry treatment apparatus according to claim 5, further comprising a valve for preventing a siphon phenomenon from occurring in the drain channel.

8. The laundry treatment apparatus according to claim 5, wherein the channel connection unit is located at the point at which the first connection channel and the second connection channel are connected to each other, and wherein the channel connection unit is configured to couple the second connection channel to the rear surface of the drawer and to allow the second connection channel to rotate about a shaft perpendicular to a bottom surface of the drawer.

9. The laundry treatment apparatus according to claim 5, wherein the channel connection unit is located at the point at which the first connection channel and the second connection channel are connected to each other, wherein the channel connection unit connects the first connection channel and the second connection channel to each other, and wherein one of the first connection channel or the second connection channel is configured to rotate in a circumferential direction of the other of the first connection channel or the second connection channel.

10. The laundry treatment apparatus according to claim 4, further comprising:

a guide comprising a first body rotatably coupled to the cabinet and a second body having a first end rotatably coupled to the first body and a second end rotatably coupled to the drawer; and a water supply unit for guiding water supply from a water source to the tub, the water supply unit being supported by the guide.

11. The laundry treatment apparatus according to claim 10, further comprising:

a drain connection pipe provided in the first body for defining a movement path of water, wherein the second connection channel allows the first connection channel and the drain channel to communicate with each other via the drain connection pipe.

12. The laundry treatment apparatus according to claim 11, wherein the second connection channel comprises a first drain pipe for connecting the first connection channel and the drain connection pipe to each other and a second drain pipe for connecting the drain connection pipe and the drain channel to each other.

13. The laundry treatment apparatus according to claim 11 or 12, further comprising:

a water supply connection pipe provided in the first body for defining a movement path of water, the water supply connection pipe being separate from the drain connection pipe, wherein the water supply unit comprises a first water supply channel for connecting the water supply connection pipe to the water source and a second water supply channel for guiding water in the water supply connection pipe to the tub, the second water supply channel being supported by the second body.

14. The laundry treatment apparatus according to claim 1, wherein the drain pump comprises: a drain chamber fixed to the rear surface of the drawer; and a chamber communication pipe provided at a lower end of the drain pump for allowing the drain pump and the tub to communicate with each other, and the first connection channel connects the drain chamber to the channel connection unit.

15. The laundry treatment apparatus according to claim 1, wherein the first connection channel is inclined downward toward the drain pump.

16. The laundry treatment apparatus according to claim 1, wherein the portion of the first connection channel located lower than the bottom surface of the tub is inclined downward toward the drain pump.

17. The laundry treatment apparatus according to claim 1, wherein the drain pump is provided at an area adjacent to an edge of the rear surface of the drawer.

18. A laundry treatment apparatus comprising:

a cabinet having an opening;

a drawer configured to be withdrawn from the cabinet through the opening;

a tub located in the drawer for receiving water and laundry;

a drain pump configured to discharge water from the tub;

a drain channel extending through a reference point set to be higher than a highest level of water that can be stored in the tub, the drain channel being located outside the cabinet; and a connection channel that is located in the cabinet and that connects the drain pump and the drain channel to each other, wherein a portion of the drain pump is located lower than a bottom surface of the tub, a channel connection unit configured to fix the connection channel to a rear surface of the drawer, wherein a remaining portion of the drain pump is located higher than the bottom surface of the tub, wherein the connection channel comprises (i) a first connection channel that is fixed to the rear surface of the drawer and that connects the drain pump to the channel connection unit, and (ii) a second connection channel that is separate from the first connection channel, that connects the first connection channel to the drain channel, wherein the channel connection unit connects the first connection channel and the second connection channel to each other, wherein the second connection channel is configured to be spaced apart from the rear surface of the drawer based on the drawer being withdrawn, and wherein the channel connection unit is located higher than the bottom surface of the tub to prevent the second connection channel from freezing.

* * * * *